US007524384B2

(12) United States Patent
Bouzekri

(10) Patent No.: US 7,524,384 B2
(45) Date of Patent: Apr. 28, 2009

(54) METAL CONTAINER COMPRISING A STEEL SHEET WITH LOW ALUMINUM CONTENT

(75) Inventor: Mohamed Bouzekri, Rombas (FR)

(73) Assignee: Sollac, Puteaux (FR)

( * ) Notice: Subject to any disclaimer, the term of this patent is extended or adjusted under 35 U.S.C. 154(b) by 333 days.

(21) Appl. No.: 11/339,545

(22) Filed: Jan. 26, 2006

(65) Prior Publication Data

US 2006/0137770 A1 Jun. 29, 2006

Related U.S. Application Data

(63) Continuation of application No. 09/610,224, filed on Jul. 3, 2000, now Pat. No. 7,169,244.

(30) Foreign Application Priority Data

Jul. 1, 1999 (FR) ..... 99 08416

(51) Int. Cl.
*C22C 38/04* (2006.01)
*C22C 38/06* (2006.01)

(52) U.S. Cl. ..... 148/328; 148/320

(58) Field of Classification Search ..... 148/320, 148/328, 603, 651, 652, 661, 622–624; 420/128
See application file for complete search history.

(56) References Cited

U.S. PATENT DOCUMENTS

| | | | |
|---|---|---|---|
| 4,050,959 | A | 9/1977 | Nakaoka et al. |
| 6,156,131 | A | 12/2000 | Sardoy et al. |
| 6,358,338 | B1 | 3/2002 | Guelton et al. |
| 6,398,887 | B1 | 6/2002 | Bouzekri |
| 6,478,901 | B1 | 11/2002 | Bouzekri |
| 6,673,170 | B1 | 1/2004 | Bouzekri |
| 6,776,856 | B2 | 8/2004 | Bouzekri |
| 6,974,511 | B1 | 12/2005 | Bouzekri |
| 2004/0221928 | A1 | 11/2004 | Bouzekri |

FOREIGN PATENT DOCUMENTS

| | | | |
|---|---|---|---|
| DE | 196 22 164 C 1 | | 5/1997 |
| EP | 0 073 092 | A1 | 3/1983 |
| EP | 0 764 725 | A1 | 3/1997 |
| FR | 2 291 277 | A | 6/1976 |
| JP | 07-034192 | | 2/1995 |

OTHER PUBLICATIONS

English abstract of Japanese patent 07034136A.
U.S. Appl. No. 10/565,558, filed Jan. 23, 2006, Bouzekri et al.
U.S. Appl. No. 11/339,545, filed Jan. 26, 2006, Bouzekri.
U.S. Appl. No. 09/610,224, filed Jul. 3, 2000, Bouzekri.

*Primary Examiner*—Deborah Yee
(74) *Attorney, Agent, or Firm*—Oblon, Spivak, McClelland, Maier & Neustadt, P.C.

(57) ABSTRACT

The present invention provides a steel sheet with low aluminum content, which includes:

between 0.050 and 0.080% by weight of carbon,
between 0.25 and 0.40% by weight of manganese,
less than 0.020% by weight of aluminum, and
between 0.010 and 0.014% by weight of nitrogen, the remainder being iron and inevitable trace impurities, wherein
when in an aged condition the sheet includes a percentage elongation A% satisfying the relationship:

$$(750-Rm)/16.5 \leqq A\% \leqq (850-Rm)/17.5$$

where Rm is the maximum rupture strength of the steel, expressed in Mpa. Another embodiment of the invention provides a container, which includes or is made from the above-mentioned steel sheet.

7 Claims, 3 Drawing Sheets

METAL CONTAINER COMPRISING A STEEL SHEET WITH LOW ALUMINUM CONTENT

This application is a continuation of case Ser. No. 09/610,224 filed Jul. 3, 2000, now U.S. Pat. No. 7,169,244.

BACKGROUND OF THE INVENTION

1. Field of the Invention

The present invention relates to the area of steels for application in the field of metal containers for food, non-food products or industrial purposes.

2. Discussion of the Background

The steels smelted for uses specific to metal containers differ from thin sheets in particular by their physical characteristics.

The thicknesses of steel sheets for containers vary from 0.12 mm to 0.25 mm for the great majority of uses, but can reach greater thicknesses, as much as 0.49 mm, for very special applications. This is the case, for example, of certain containers for non-food products, such as certain aerosols, or the case of certain industrial containers. Their thickness can also be as small as 0.08 mm, in the case of food receptacles, for example.

Steel sheets for containers are usually coated with a metal coat (tin which may or may not be remelted, or chrome), on which there is generally deposited an organic coat (varnish, inks, plastic films).

In the case of two-piece containers, these are made by deep-drawing under a blank holder or by deep-drawing/trimming for beverage cans, and are generally cylindrical or frustoconical, axially symmetric cans. The container designers are showing increasing interest in even thinner steels, however, with thickness from 0.12 mm to 0.075 mm and, with the objective of distinguishing themselves from the competitors, they are trying to introduce increasingly more complex shapes. Thus we now find cans of original shapes, manufactured from steel sheets of small thicknesses, which sheets, even though presenting greater forming difficulties, must meet the use criteria (mechanical durability of the containers, resistance to the axial load to which they are subjected during storage in stacks, resistance to the internal overpressure to which they are subjected during sterilizing heat treatment and to the internal partial vacuum to which they are subjected after cooling) and therefore must have very high mechanical strength.

Thus the use and performance of these containers are believed to depend on a certain number of mechanical characteristics of the steel:

coefficient of planar anisotropy, ΔC aniso,
Lankford coefficient,
yield strength $R_e$,
maximum rupture strength Rm,
elongation A%,
distributed elongation Ag%.

To impart to the container equivalent mechanical strength at smaller steel thickness, it is preferable that the steel sheet present a higher maximum rupture strength.

It is known that containers can be made by using steels with low aluminum content, and in particular steels known as "renitrided low-aluminum steels". Such a steel is, for example, described in French Patent Application No. 95-11113.

The carbon content usually sought for this type of steel ranges between 0.050% and 0.080%, the manganese content between 0.20% and 0.45%. The aluminum content is controlled to a value of less than 0.020% with the objective of imparting to the steel sheet an improved microstructure, good freedom from inclusions and, consequently, high mechanical characteristics.

The nitrogen content is also controlled, and ranges between 0.008 and 0.016%. This nitrogen content is ensured by addition of calcium cyanamide to the ladle during smelting of the steel, or by blowing gaseous nitrogen into the steel bath. The known benefit of the nitrogen addition is to harden the steel by solid solution effect.

These steel sheets are made by cold rolling a hot strip to a cold-rolling ratio of between 75% and more than 90%, followed by continuous annealing at a temperature of between 640 and 700° C., and a second cold-rolling with a percentage elongation which varies between 2% and 45% during this second cold-rolling depending on the desired level of maximum rupture strength Rm.

For steels with low aluminum contents, however, high mechanical characteristics are associated with poor elongation capacity. This poor ductility, apart from the fact that it is unfavorable to forming of the container, leads during such forming to thinning of the walls, a phenomenon which will be unfavorable to the performances of the container.

Thus for example, a "renitrided low-aluminum" steel with a maximum rupture strength Rm on the order of 550 MPa will have a percentage elongation A% on the order of only 2 to 5%.

SUMMARY OF THE INVENTION

One object of the present invention is to provide a steel sheet with low aluminum content for containers, which sheet has a higher percentage elongation A% than that of prior art steels with low aluminum content but equivalent level of maximum rupture strength.

This and other objects have been attained by the present invention, the first embodiment of which provides a process for manufacturing a steel strip with low aluminum content, which includes:

hot-rolling a steel strip which includes between 0.050 and 0.080% by weight of carbon, between 0.25 and 0.40% by weight of manganese, less than 0.020% by weight of aluminum, and between 0.010 and 0.014% by weight of nitrogen, the remainder being iron and inevitable trace impurities, to form a strip;

subjecting the strip to a first cold-rolling, to form a cold-rolled strip;

annealing the cold-rolled strip, to form an annealed cold-rolled strip;

optionally, subjecting the annealed cold-rolled strip to a secondary cold-rolling;

wherein the annealing is a continuous annealing which includes:

raising the temperature of the strip to a temperature higher than the temperature of onset of pearlitic transformation $Ac_1$, holding the strip above this temperature for a duration of longer than 10 seconds, and rapidly cooling the strip to a temperature below 350° C. at a cooling rate in excess of 100° C. per second.

Another embodiment of the invention provides a steel strip, produced by the above-mentioned process.

Another embodiment of the invention provides a steel sheet with low aluminum content, which includes:

between 0.050 and 0.080% by weight of carbon, between 0.25 and 0.40% by weight of manganese, less than 0.020% by weight of aluminum, and between 0.010 and 0.014% by weight of nitrogen, the remainder being iron and inevitable trace impurities, wherein when in an aged condition the sheet includes a percentage elongation A% satisfying the relationship:

$$(750-Rm)/16.5 \leqq A\% \leqq (850-Rm)/17.5$$

where Rm is the maximum rupture strength of the steel, expressed in MPa.

Another embodiment of the invention provides a container, which includes or is made from the above-mentioned steel sheet.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
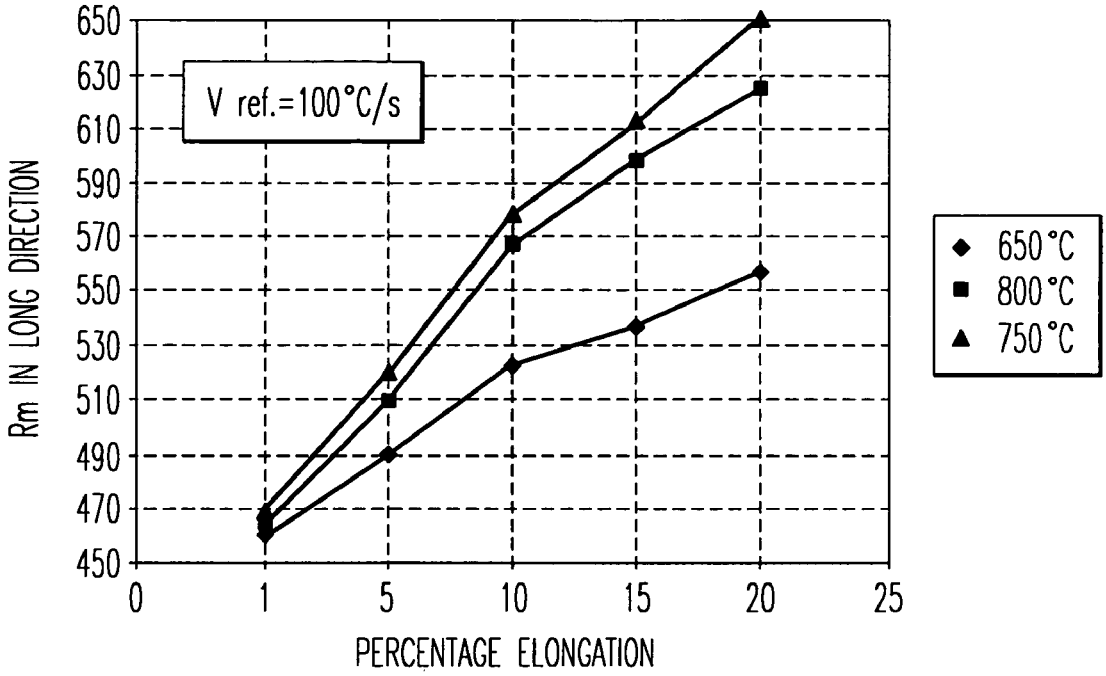
FIGS. 1 and 2 are diagrams showing the influence of annealing temperature on maximum rupture strength Rm.

Various other objects, features and attendant advantages of the present invention will be more fully appreciated as the same becomes better understood from the following detailed description of the preferred embodiments of the invention.

Preferably, the process for manufacturing a steel strip with low aluminum content for containers includes:

- a hot-rolled steel strip is supplied which contains by weight between 0.050 and 0.080% of carbon, between 0.25 and 0.40% of manganese, less than 0.020% of aluminum, and between 0.010 and 0.014% of nitrogen, the remainder being iron and the inevitable trace impurities,
- the strip is passed through a first cold-rolling,
- the cold-rolled strip is subjected to annealing,
- a secondary cold-rolling is performed if necessary, characterized in that the annealing is a continuous annealing in which the cycle comprises a temperature rise up to a temperature higher than the temperature of onset of pearlitic transformation Ac, holding the strip above this temperature for a duration of longer than 10 seconds, and rapidly cooling the strip to a temperature of below 350° C. at a cooling rate in excess of 100° C. per second.

According to a preferred embodiment of the process of the invention:

- the strip is maintained during annealing at a temperature of between $Ac_1$ and 800° C. for a duration ranging from 10 seconds to 2 minutes;
- the cooling rate is between 100° C. and 500° C. per second;
- the strip is cooled at a rate In excess of 100° C. per second to room temperature.

The invention also preferably relates to a steel sheet with low aluminum content, comprising by weight between 0.050 and 0.080% of carbon, between 0 25 and 0.40% of manganese, less than 0.020% of aluminum, and between 0.010 and 0.014% of nitrogen, the remainder being iron and the inevitable trace impurities, which steel is manufactured according to the foregoing process, characterized in that it has in the aged condition a percentage elongation A% satisfying the relationship:

$$(750-Rm)/16.5 \leqq A\% \leqq (850-Rm)/17.5$$

where Rm is the maximum rupture strength of the steel, expressed in MPa.

According to another preferred embodiment of the invention, the steel contains carbon in free state and/or some carbides precipitated at low temperature, and it has a grain count per $mm^2$ greater than 30000.

Influence of the Composition of the Steel

Preferably, the invention does not relate to the composition of the steel, which is a standard steel with low aluminum content.

As for all renitrided steels with low aluminum content, it is believed that the aluminum and nitrogen contents are important:

- the aluminum is used to kill the steel. It is limited to 0 020% (preferably less than or equal to 0.015%, and more preferably less than or equal to 0.010%) in order to impart to the steel sheet an improved microstructure, good freedom from inclusions and, consequently, high mechanical characteristics;
- the nitrogen content is also controlled, and ranges between 0.008 and 0.016% (preferably between 0.009 and 0.014%, and more preferably between 0.010 and 0.012%). This nitrogen content is ensured by addition of calcium cyanamide to the ladle during smelting of the steel, or by blowing gaseous nitrogen into the steel bath. The known benefit of the nitrogen addition is to harden the steel by solid-solution effect.

Carbon and manganese are also two elements which it is preferable to control.

- the carbon content preferably sought for this type of steel ranges between 0.050% and 0.080%, more preferably between 0.055 and 0.075%, and most preferably between 0.060 and 0.070%;
- the manganese content ranges between 0 25% and 0.40%, more preferably between 0.27 and 0.37%, and most preferably between 0.30 and 0.35%.

Influence of the Hot-Denaturing Conditions

The continuously annealed renitrided steels with low aluminum content are preferably rolled at a temperature above $Ar_3$.

The preferable parameter is the coiling temperature, cold coiling between 500 and 650° C. being preferred. More preferably, cold coiling between 500 and 620° C. is carried out, more particularly preferably between 520 and 600° C., and most preferably between 550 and 585° C. Hot coiling, at a temperature above 650° C., presents two drawbacks:

- it generates heterogeneities in mechanical characteristics related to the differences between the cooling rates of the core and the extremities of the strip;
- it leads to a risk of abnormal grain growth, which can occur for certain combinations (temperature at end of rolling, coiling temperature) and can constitute a latent defect both in hot sheet and in cold sheet.

Nevertheless, hot coiling may be achieved by using, for example, a selective coiling method, in which the temperature is higher at the extremities of the strip.

Influence of the Cold-Rolling Conditions

By virtue of the small final thicknesses to be achieved, the range of cold reduction ratio preferably extends from 75% to more than 90%, more preferably from 80% to more than 88%, and most preferably from 82% to more than 85%.

The main factors involved in the definition of the cold reduction ratio are preferably the final thickness of the product, which can be influenced by choice of the thickness of the hot product, and also metallurgical considerations.

The metallurgical considerations are based on the influence of the cold reduction ratio on the microstructural condition and, consequently, on the mechanical characteristics after recrystallization and annealing. Thus an increase in cold reduction ratio leads to a lower recrystallization temperature, to smaller grains and to higher values of Re and Rm. In particular, the reduction ratio has a very strong influence on the Lankford coefficient.

In the case of requirements applicable to deep-drawing spurs, it is appropriate, for example, to optimize the steel grade, especially the carbon content, and the reduction ratio of cold rolling with the hardness or the desired mechanical characteristics in order to obtain a metal known as "spur-free metal".

Influence of Annealing

It is preferable that the annealing temperature be higher than the point of onset of pearlitic transformation Ac, (on the order of 720° C. for this type of steel). More preferably, the annealing temperature is higher than 750° C., more particularly preferably higher than 780° C., and most preferably higher than 810° C.

Another important characteristic of the invention resides in the cooling rate which must be greater than 100° C./s. More preferably, the cooling rate is greater than 120° C./s, more particularly preferably, greater than 130° C./s and most preferably greater than 140° C./s.

While the strip is being held at a temperature above Ac, there is formed carbon-rich austenite. The rapid cooling of this austenite allows a certain quantity of carbon to be maintained in free state and/or fine and disperse carbides to be precipitated at low temperature. This carbon in free state and/or these carbides formed at low temperature favor blocking of dislocations, thus making it possible to achieve high levels of mechanical characteristics without necessitating a large reduction ratio during the ensuing second cold-rolling step.

It is therefore preferable to perform rapid cooling, between 100 and 500° C./s, at least to a temperature below 350° C. More preferably between 125 and 475° C./s, more particularly preferably between 135 and 450° C./s, and most preferably between 175 and 425° C./s. If the rapid cooling is stopped before 350° C., the atoms of free carbon will be able to combine and the desired effect will not be achieved. Preferably, the rapid cooling is carried out to a temperature below 325° C., more preferably to below 310° C. and most preferably to below 300° C. Rapid cooling to room temperature is also preferred.

It is also possible to perform cooling at a rate faster than 500° C./s, but the Applicant has observed that the influence of an increase in cooling rate beyond 500° C./s is not very significant.

Figure 2:
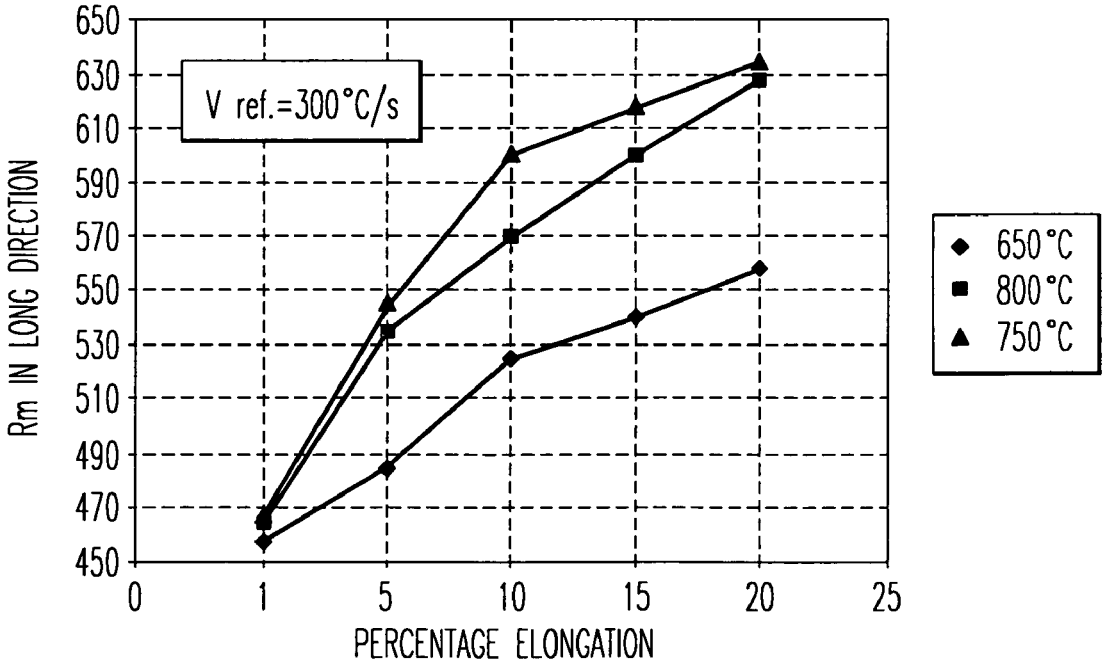

FIGS. 1 and 2 show the influence of annealing temperature at constant cooling rate (target rate 100° C.; actual rate 73 to 102° C./s on FIG. 1; target rate 300° C.; actual rate 228 to 331° C./s on FIG. 2) on the maximum rupture strength Rm.

It is evident from these figures that, for identical percentage elongation in the second ruling, Rm is clearly greater for the steels annealed at 750° C. and at 800° C. compared with the same steel annealed at 650° C.

Nevertheless, this influence of annealing temperature on maximum rupture strength Rm is not very perceptible when the percentage elongation in the second cold-rolling is less than 3%. It becomes truly significant preferably starting from 5% elongation in the second cold-rolling.

If the temperature is too high (above 800° C.), there occurs at least partial precipitation of the nitrogen in the form of aluminum nitrides. This precipitated nitrogen no longer contributes to hardening of the steel, and the resulting effect is lowering of the maximum rupture strength Rm. There are signs of this phenomenon in FIG. 2, where it is noted that, for percentage elongations greater than 10%, the increase in maximum rupture strength Rm between the sample annealed at 750° C. and the sample annealed at 800° C. becomes smaller.

The time for which the strip is held between Act and 800° C. must be sufficient to return all the carbon corresponding to equilibrium to solution. A holding time of 10 seconds is preferable to ensure this return to solution of the quantity of carbon corresponding to equilibrium for the steels whose carbon content ranges between 0.020 and 0.035%, and a holding time of longer than 2 minutes, although possible, is impractical and costly. Preferably, the holding time ranges from 15 seconds to 1.7 minutes, more preferably from 20 seconds to 1.5 minutes, more particularly preferably from 25 seconds to 1.3 minutes, and most preferably from 30 seconds to one minute.

Figure 3:
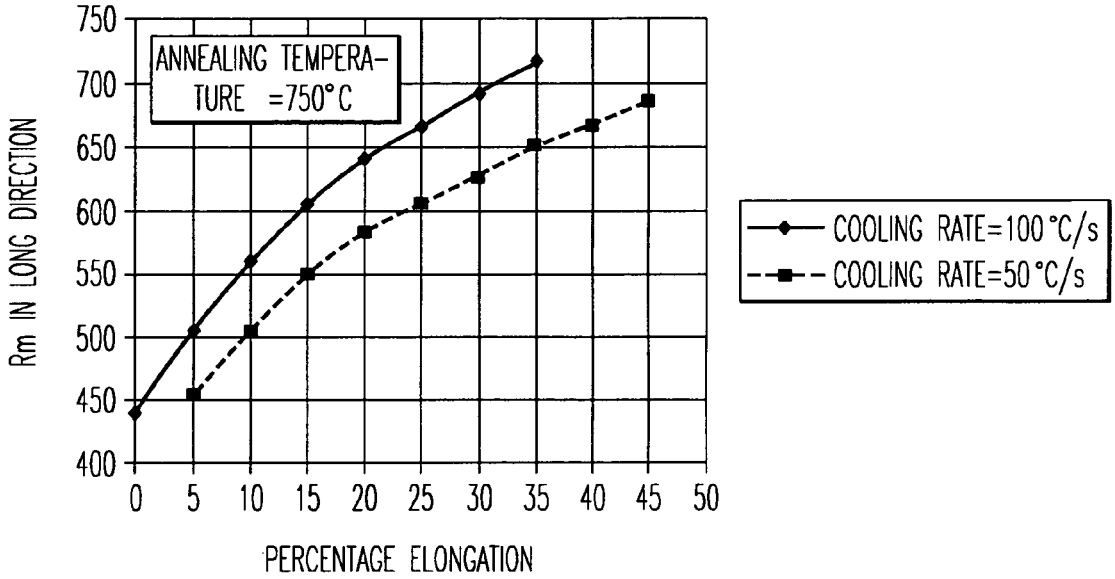
FIG. 3 is a diagram showing the influence of cooling rate on maximum rupture strength Rm.
Figure 4:
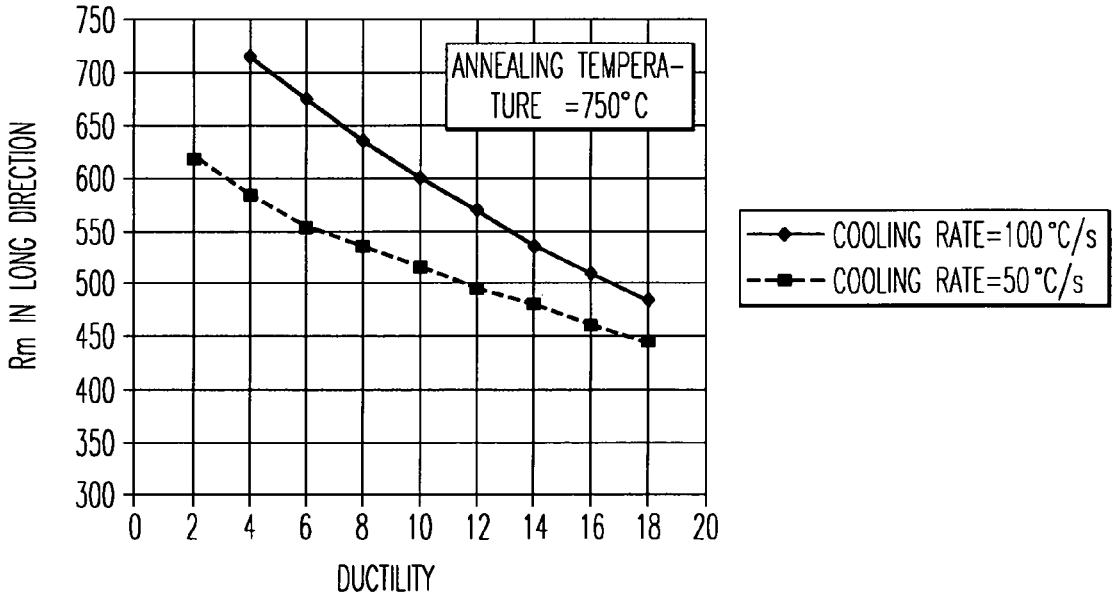
FIG. 4 is a diagram showing the influence of cooling rate on maximum rupture strength Rm and on the percentage elongation A%.

FIGS. 3 and 4 show the influence of cooling rate at constant annealing temperature (750° C.) maintained for 20 seconds.

As can be seen in FIG. 3, at 10% elongation in the second cold-rolling, the maximum rupture strength Rm of the steel is equal to about 560 MPa if the cooling rate is equal to 100° C./s, whereas it reaches only 505 MPa if the cooling rate is equal to 50° C./s.

It is therefore possible to obtain a steel with low aluminum content whose value of Rm is equal to 560 MPa with only 10% elongation in the second cold-rolling if the cooling rate is equal to 100° C./s whereas a second cold-rolling must be carried out with a percentage elongation of 17% if the cooling rate is only 50° C./s.

By virtue of this smaller percentage elongation in the second cold-rolling step, it is possible to minimize the loss of ductility of the steel. In FIG. 4, for example, it is evident that the steel whose Rm is equal to 560 MPa has a ductility A% equal to 12.5 when the cooling rate is equal to 100° C./s, whereas it is equal to 5.5 when the cooling rate is equal to 50° C./s.

Figure 5:
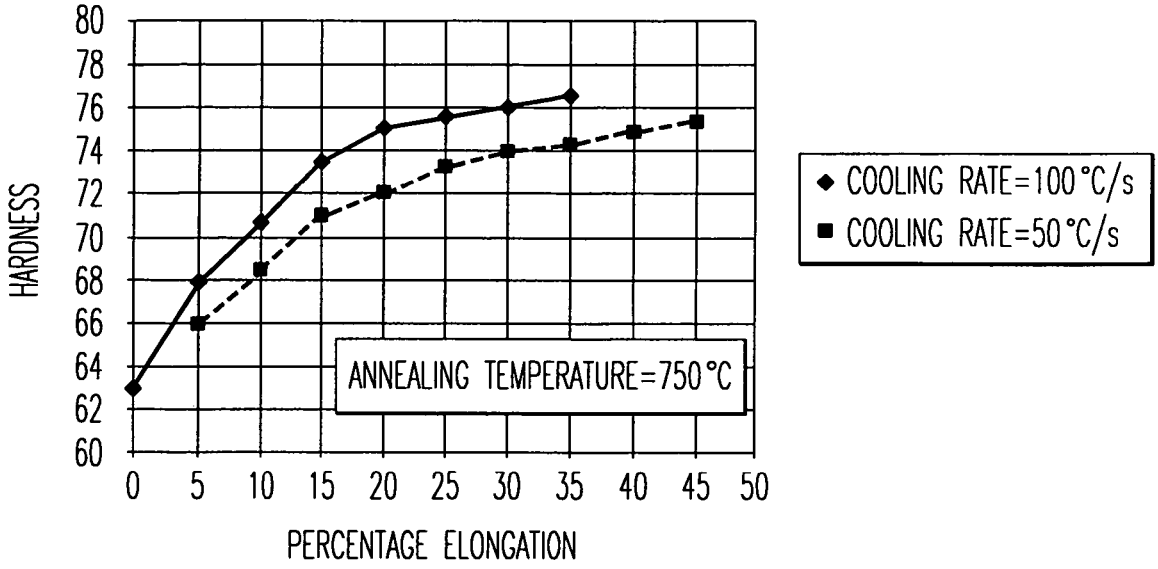
FIG. 5 is a diagram showing the influence of cooling rate on hardness HR30T.

This observation is also valid for the hardness of the steel. As is evident from FIG. 5, for the same percentage elongation in the second cold-rolling, the hardness of the steel increases if the cooling rate is equal to 100° C./s. This increase of the hardness is due to a higher content of free carbon and/or to the presence of fine and disperse precipitates.

The micrographic analyses of the samples revealed that the grain count per $mm^2$ is larger (greater than 30000), and that the carbides, when they are formed, include intergranular cementite. Preferably, the grain count per $mm^2$ is greater than 35,000, more preferably, greater than 37,000, more particularly preferably, greater than 39,000, and most preferably greater than 40,000.

Thus this manufacturing process makes it possible to obtain a steel with low aluminum content for containers, comprising by weight between 0.050 and 0.080% of carbon, between 0.25 and 0.40% of manganese, less than 0.020% of aluminum, and between 0.010 and 0.014% of nitrogen, the remainder being iron and the inevitable trace impurities, which steel has in the aged condition a percentage elongation A% satisfying the relationship:

$$(750-Rm)/16.5 \leqq A\% \leqq (850-Rm)/17.5$$

where Rm is the maximum rupture strength of the steel, expressed in MPa.

EXAMPLES

Having generally described this invention, a further understanding can be obtained by reference to certain specific examples which are provided herein for purposes of illustration only and are not intended to be limiting unless otherwise specified.

The following tests relate to two cold coils of steel with low aluminum content, whose characteristics are presented in Table 1 hereinafter.

TABLE 1

| | Contens ($10^{-3}$%) | | | | Hot rolling | | | Cold rolling | |
|---|---|---|---|---|---|---|---|---|---|
| | | | | | Rolling end temp. | Upcoiling temp. | Thickness | Red. ratio (%) | Thickness |
| | C | Mn | Al | N | (° C.) | (° C.) | (mm) | | (mm) |
| A | 59 | 345 | 15 | 10.5 | 842 | 598 | 2.06 | 91.2 | 0.18 |
| B | 66 | 309 | 17 | 12 | 841 | 587 | 2.00 | 87 | 0.28 |

The coil symbol is shown in the first column; the second through fifth columns indicate the contents in $10^{-3}$ wt % of the main constituents of importance. The sixth through eighth columns relate to the hot-rolling conditions: in the sixth column there is indicated the temperature at the end of hot rolling; in the seventh column the coiling temperature; in the eighth column the thickness of the hot strip. Finally, columns nine and ten relate to the cold-rolling conditions: in the ninth column there was indicated the percentage reduction achieved by cold rolling and in the tenth column the final thickness of the cold strip.

These two standard strips were subjected to different annealings followed by second cold-rollings, which were also different.

The holding temperatures in annealing varied from 650° C. to 800° C., the cooling rates varied from 40° C./s to 400° C./s and the percentage elongations in the second rolling varied from 1% to 42%.

In addition to the micrographic examinations, the characterization of the metal obtained from these different tests comprised on the one hand performing tension tests on 12.5×50 ISO specimens in the rolling direction and in the cross direction, in both the fresh condition and in the aged condition after aging at 200° C. for 20 minutes, and on the other hand determining the hardness HR30T, also in both the fresh condition and in the aged condition.

On the basis of these tests it was demonstrated that it is possible considerably to increase the maximum rupture strength Rm for the same steel with low aluminum content and identical percentage elongation in the second cold-rolling, if a continuous annealing according to the conditions of the invention is performed between the two cold-rollings.

In other words, it was demonstrated on the basis of these tests that it is possible considerably to increase the ductility A% for the same steel with low aluminum content and identical maximum rupture strength Rm if a continuous annealing according to the conditions of the invention is performed between the two cold-rollings, because the same level of Rm is achieved with a smaller percentage elongation during the second rolling. Thus it becomes possible to obtain steed grades with low aluminum content and an Rm level on the order of 380 MPa without necessitating a second rolling step after annealing, other than, perhaps, a light work-hardening operation known as skin pass, in order to suppress the yield-strength plateau present on the metal upon discharge from annealing.

The entire contents of each of the aforementioned patents, references and published application are hereby incorporated by reference, the same as if set forth at length.

Having now fully described this invention, it will be apparent to one of ordinary skill in the art that many changes and modifications can be made thereto without departing from the spirit or scope of the invention as set forth herein.

This application is based on French Patent Application No. 9908416, filed Jul. 1, 1999, and incorporated herein by reference in its entirety.

The invention claimed is:

1. A metal container for food, the metal container comprising a steel sheet with low aluminum content, comprising:

between 0.050 and 0.080% by weight of carbon, between 0.25 and 0.40% by weight of manganese, less than 0.020% by weight of aluminum, and between 0.010 and 0.014% by weight of nitrogen, the remainder being iron and inevitable trace impurities, wherein the steel sheet is in an aged condition such that the sheet comprises a percentage elongation A% satisfying the relationship:

$$(750-Rm)/16.5 \leqq A\% \leqq (850-Rm)/17.5$$

where Rm is the maximum rupture strength of the steel, expressed in MPa.

2. The metal container for food according to claim 1, further comprising:

at least one selected from the group consisting of carbon in the free state and a plurality of carbides precipitated at low temperature; and a grain count per $mm^2$ greater than 30000.

3. The metal container for food according to claim 1, wherein the steel sheet comprises between 0.055 and 0.075% by weight of carbon.

4. The metal container for food according to claim 1, wherein the steel sheet comprises between 0.27 and 0.37% by weight of manganese.

5. The metal container for food according to claim 1, wherein the steel sheet comprises less than 0.015% by weight of aluminum.

6. The metal container for food according to claim 1, wherein the steel sheet comprises between 0.010 and 0.012% by weight of nitrogen.

7. The metal container for food according to claim 2, wherein the grain count per $mm^2$ is greater than 35000.

* * * * *